US006317981B1

(12) United States Patent
Clive-Smith

(10) Patent No.: US 6,317,981 B1
(45) **Date of Patent: *Nov. 20, 2001**

(54) CONTAINERS

(75) Inventor: Martin Clive-Smith, Leek Wootton (GB)

(73) Assignee: Clive Smith Associates, Warwickshire (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/872,247

(22) Filed: Jun. 10, 1997

Related U.S. Application Data

(60) Provisional application No. 60/019,478, filed on Jun. 10, 1996.

(51) Int. Cl.[7] ..... B21D 47/01; B23P 11/02

(52) U.S. Cl. ..... 29/897.35; 29/446; 29/452

(58) Field of Search ..... 108/55.1, 57.32, 108/57.33, 51.11, 901; 29/897.35, 897.2, 450, 452, 446

(56) References Cited

U.S. PATENT DOCUMENTS

| | | | | |
|---|---|---|---|---|
| 322,049 | * | 7/1885 | Emery | 29/897.35 |
| 2,039,398 | * | 5/1936 | Dye | 29/897.35 |
| 2,705,120 | * | 3/1955 | Owen | 108/51 |
| 2,887,762 | * | 5/1959 | Dobell | 29/897.35 |
| 3,626,869 | * | 12/1971 | Colas | 108/51 |
| 3,626,872 | * | 12/1971 | Cully | 108/51.1 |
| 3,675,596 | * | 7/1972 | Colas | 108/51 |
| 3,726,236 | * | 4/1973 | Colas | 108/51 |
| 4,353,520 | * | 10/1982 | Jansson | 248/346 |
| 4,586,646 | * | 5/1986 | Booher | 228/44.3 |
| 4,638,744 | * | 1/1987 | Clive-Smith | 108/55.1 |
| 4,709,456 | * | 12/1987 | Iyer | 29/446 |
| 4,773,546 | * | 9/1988 | Konstant | 211/151 |
| 4,966,085 | * | 10/1990 | Howe | 108/55.1 |
| 5,042,396 | * | 8/1991 | Shuert | 108/901 |
| 5,398,832 | * | 3/1995 | Clive-Smith | 220/1.5 |
| 5,609,111 | * | 3/1997 | Hasegawa et al. | 108/55.1 |
| 5,687,653 | * | 11/1997 | Bumbarner | 108/51.1 |
| 5,809,907 | * | 9/1998 | Bumgardner | 108/51.11 |

FOREIGN PATENT DOCUMENTS

| | | | | |
|---|---|---|---|---|
| 2502030 | * | 7/1975 | (DE) | 108/55.1 |

* cited by examiner

*Primary Examiner*—S. Thomas Hughes
*Assistant Examiner*—Marc Jimenez
(74) *Attorney, Agent, or Firm*—Oppenheimer Wolff & Donnelly LLP

(57) ABSTRACT

A method of assembling a platform-based container comprising a base having at least one longitudinal beam, wherein the method comprises pre-loading the longitudinal beam, prior to the completion of the assembly of the container. The beam is then used in the assembly of the container, resulting in a container which no longer takes a permanent deformation under maximum load.

11 Claims, 3 Drawing Sheets

CONTAINERS

This application claims benefit of Prov. No. 60/019,478 filed Jun. 10, 1996.

I. BACKGROUND

In the field of shipping containers there is a series of containers called platform-based containers comprising a rectangular platform base. Sometimes these have erect corner posts at either end and are then known as flatracks. The bases of the platforms comprise a framework of longitudinal beams and transverse members.

Hot rolled I beams used to be used in the construction. However these were found too heavy and it is now more common for the beams to be fabricated from steel plate and sheet. The fabrication technique is to weld the pieces of steel together to form an I section beam similar to the earlier hot rolled type. Added to the beams are stake pockets, lashing devices, recesses for folding posts and so on. Thus, there can be a significant amount of heat generated by welding and cutting resulting in an accumulation of residual stresses in the beams.

After the beam is built into the platform base, the base is fitted out with a deck, typically timber and thus presented for carrying cargo. The platforms are mostly supported at their end corners such that as cargo is loaded onto the base, the base naturally deflects downwardly.

It has been found that when loaded the beams can deflect significantly more than established theory predicts, and on removal of the load, the beams are found permanently deformed. Such deformation is not acceptable. It has been suggested that the cause of the deformation is that the combined residual stress plus the bending stress caused by the load exceeds the elastic limit of the steel, and thus the steel yields.

To overcome this problem, it is usual to increase the strength of the beams. So one method is to use steel with a much higher yield point so that perhaps the combination of bending stress plus residual stress still falls under the elastic limit of the steel. This saves weight of steel but adds the cost of higher strength steel.

Alternatively, the beams can be reinforced with extra steel to reduce the bending stress once more adding cost, but also weight.

Another device is to stress relieve the beams allowing residual stresses to dissipate. Stress relieving can be done by applying heat to the base such as occurs when the bases are sometimes hot dip galvanized, or by shot blasting or peaning the surface, or by vibration.

Alternative residual stresses can be kept sufficiently low by careful welding to keep heat to a minimum, and by using stress relieved steel plate.

However all these methods are expensive, inconvenient for fast commercial production and the resulting geometry of the bases cannot easily be controlled from one team of welders or batch of steel to another.

II. SUMMARY OF THE INVENTION

The present invention provides a platform-based container which comprises longitudinal beams which have been pre-loaded.

The preferred embodiments of the invention will now be described by way of example only with reference to the following Figures.

III. BRIEF DESCRIPTION OF THE DRAWINGS

IV. DETAILED DESCRIPTION OF THE PREFERRED EMBODIMENT

Figure 1:
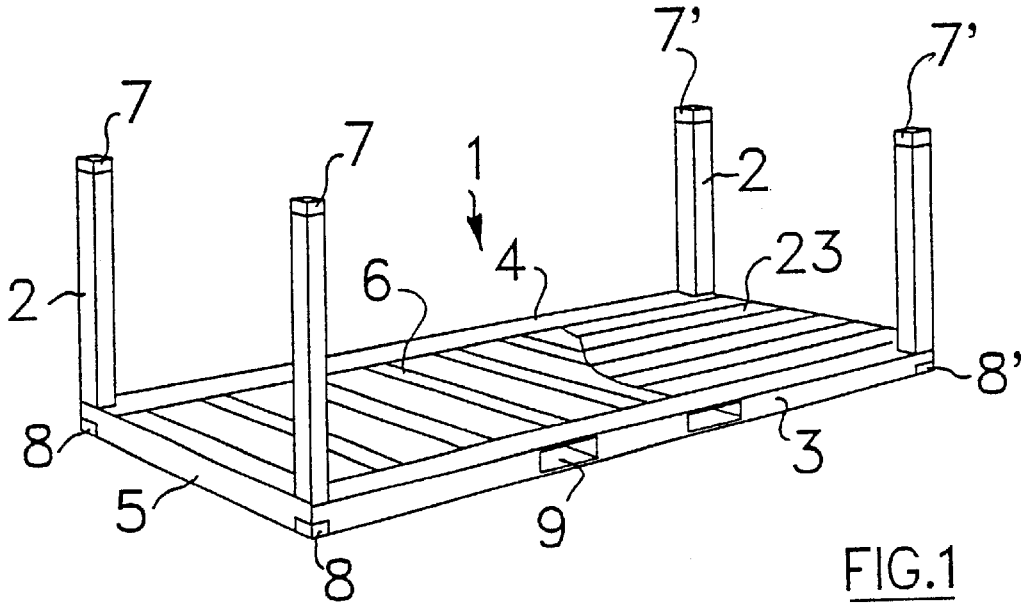
FIG. 1 is a perspective view of a platform-based container (flatrack), the floor timbers being partially cut away for clarity.

In FIG. 1 there is seen a typical platform-based container or flatrack 1 with corner posts 2 fixed in the erect position. There is a rectangular platform base 3 comprising a framework of longitudinal beams 4, one on each side, transverse end rails 5 and floor bearers 6. Floor timber 23 is fitted over the bearers 6 and cargo (not shown) laid on top of the timber 23 for carriage of the cargo.

At the top of the posts 2 are corner fittings 7, 7' and at the bottom fittings 8, 8' which are commonly located in a standardised geometric relationship to one another to enable standardised handling devices and other like containers to be connected to the fittings 7, 7', 8, 8'. Passing through the base 3 are tunnels 9 into which the tines of fork lift trucks can pass to lift the flatrack 1.

Figure 2:
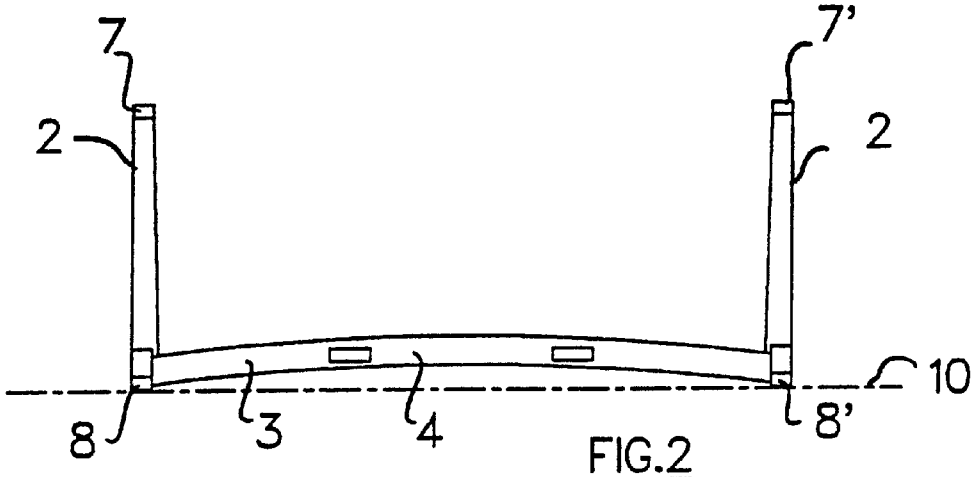
FIG. 2 is a side elevation of the flatrack of FIG. 1 prior to having a cargo load added.

FIG. 2 shows a side elevation of flatrack 1. a dotted line 10 is shown to represent a surface which might be the ground, or the bed of a transport vehicle or the roof of another container. The fittings 8, 8' rest on line 10 and base 3 is seen to be raised above the line 10 in this example in a curved camber.

Figure 3:
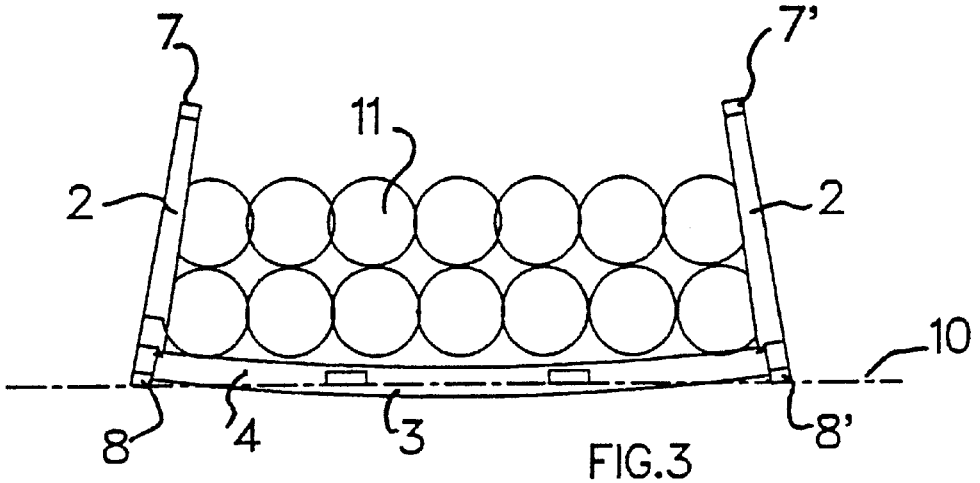
FIG. 3 is a side elevation of the flatrack 1 with a cargo load.

In FIG. 3 cargo 11 has been placed on base 3 and because of the flexible nature of the base 3, it has deflected down, and in this example its deflection exceeds line 10. Clearly if line 10 had been the roof of a container, damage might well result on the roof which would have been unacceptable. Notice also that the corner posts 2 with fittings 7, 7' have rotated inwardly quite substantially, this being in the nature of the structure.

Figure 4:
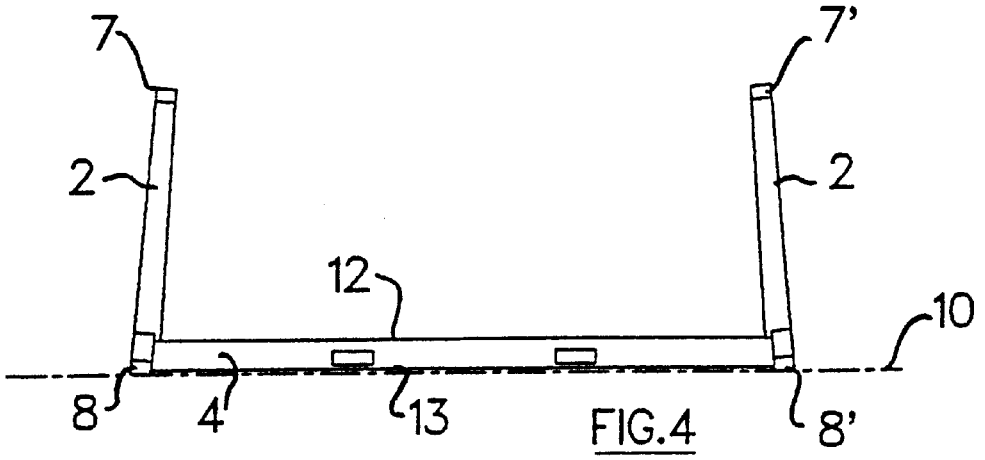
FIG. 4 is a view of the flatrack of FIG. 3 after the cargo has been removed.

In FIG. 4 the cargo has been removed and the base 3 can be seen to have had the camber removed from it and its appearance now being more horizontal and closer at its centre to line 10. The distance between top fittings 7, 7' has been shortened compared to FIG. 2. Diagrammatically, this is what happens in practice if the application of cargo 11 on base 3 combines to cause a stress beyond the yield point of the material from which the base 3 is manufactured. The ideal shape of the flatrack would have been that in FIG. 2 before loading, FIG. 4 during loading with cargo 11, with the flatrack returning elastically to the shape of the flatrack seen in FIG. 2 after removal of the cargo 11.

Figure 5:
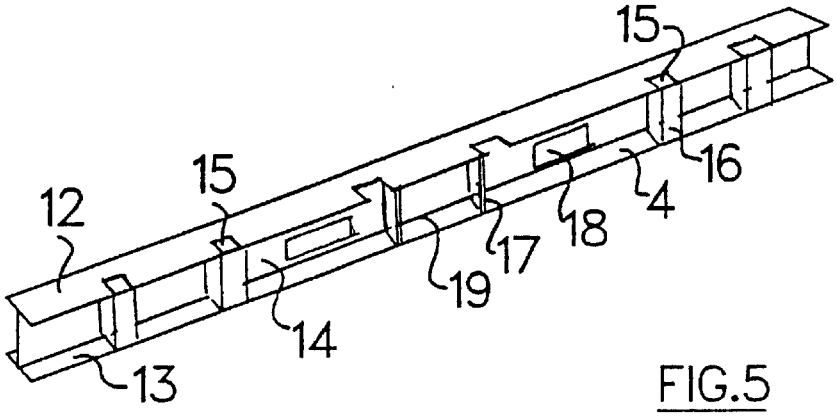
FIG. 5 is a perspective view of a beam for a flatrack according to the present invention.

In FIG. 5 there is seen in perspective a beam 4. At the left-hand end of FIG. 5, the beam section can be seen to be an 'I' profile with top flange 12, bottom flange 13 and web 14. The top flange 12 is cut away at several places to form apertures 15 under each of which is welded a respective stake pocket 16. Similar cut away areas and gussets 17 are added, and apertures 18 for the tunnels 9 are seen. The components 12, 13, 14, 16 and 17 are formed from steel sheet and plate and are welded together. Flange 13 is welded along line 19 to web 14. The welding and application of gas cutting to form apertures in the manufacture of beam 4 leads to residual stresses which can be as high as the yield point of the parent metal even before any load support demands are made of the beam 4.

Figure 6:
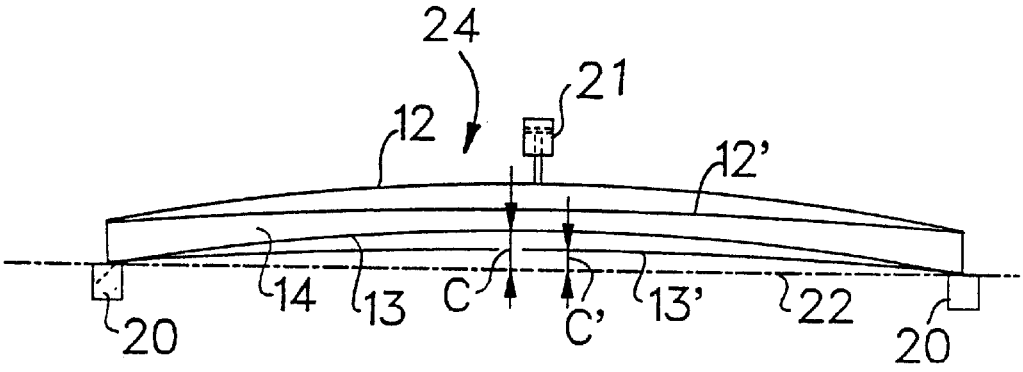
FIG. 6 is a side elevation of the beam of FIG. 5 in a pre-loaded condition.

Once welding is complete, the beam 4 is placed in a jig 24 as seen in FIG. 6 for a process called pre-loading. The pre-loading jig 24 comprises two or more fixed stops 20 to support the beam 4 and a load application device such as an hydraulic ram 21. The beam 4 with flanges 12, 13 is placed in the jig 24 resting on the stops 20. In this example it can be seen that the beam 4 is cambered a distance C measured between the flange 13 and a straight line 22 which runs through the stops 20. The ram 21 is energized and presses onto the beam 4 pressing it down towards line 22 or beyond. The amount of the load in ram 21 and the location along the beam 4 of stops 20 and ram 21 depend on the desired effect and are determined by trial and error. It might be desirable to apply the load several times in different places along beam 4 or it may be found sufficient to apply a single load only. A number of rams 21 might be used at once, located in different places along beam 4. The pre-loading of the beam 4 causes it to be deflected permanently to a new reduced camber C' measured between flange 13, the new position of the flange 13', and line 22. The flange 12 now has set at new position 12'.

Once the load is removed from beam 4 by retracting ram 21, the camber C' can be measured and if found satisfactory, beam 4 can be moved to the next stage of assembly of the platform container 1. The satisfactory camber C' is that which when the beam 4 is fitted in a platform container or flatrack as in FIG. 2 will no longer take a permanent deformation under maximum load, and at which the elastic deflection under load does not exceed the geometric requirements for safe operation. This deflection is a function of the rigidity of the beams 4 which cannot be enhanced by the pre-loading operation.

If corner posts 2 are to be fitted to base 3, then it is preferable although not essential to fit these to the beams 4 after pre-loading of beams 4 has taken place. If the posts 2 are fitted before pre-loading, the final resting geometry of the fittings 7, 7' is especially hard to control because of the amplifying nature of the long extending posts 2 from relatively shallow base 3.

One feature of the pre-loading of the beams 4 is that the top flange 12 is put into compression and can be taken beyond its elastic limit. Simultaneously, the bottom flange 13 is put into tension and likewise can be taken beyond its elastic limit. It is a feature of commercial grade steel and some other metals that when taken beyond the elastic limit and then unloaded, the steel is strain or work hardened and has its elastic limit raised to a substantially higher level. Thus pre-loading can be used to raise the elastic limit of the steel or other material used in the manufacture of beam 4 and enable beam 4 to support greater loads without deforming permanently, when these loads are applied in the direction of the pre-load. Should the beam be turned upside down and the pre-loads applied in the opposite direction to the first pre-load, the beam would be found once again having an insufficient elastic limit. The beam 4 could be work hardened in this opposite direction if required.

Since the cargo 11 to be carried will always act downwards it is an advantage of the pre-load method that it is necessary to pre-load the beams 4 only in one direction.

The work hardening of the beams 4 has another advantage. Since this process increases the elastic limit of the steel, steel with a low elastic limit (and often lower cost) can be used, and once pre-loaded, made equal to the task of supporting the cargo 11 without suffering permanent deformation. Materials with a lower elastic limit can thus be enhanced to provide an elastic structure able to support a greater load elastically. Naturally there are limits to what can be achieved in this way but typically 5 or 10% material cost savings might be achieved.

It is envisaged that other methods of pre-loading might be used such as by passing the beams 4 through roll form presses, hydraulic presses, by the application of dead weights similar to cargo 11, and any other load application method. The orientation of the jig in FIG. 6 is not critical and could be placed in a horizontal plane for example, with the beam 4 put on its side against stops 21.

Pre-loading might be applied at various stages throughout the manufacturing process. Indeed the whole finished container might be pre-loaded if so desired.

Pre-loading of a finished container might result in the corner posts 2 and top fittings 7, 7' rotating out of desired position for handling, and the base 3 deflecting down too far for safe operation. However, pre-loading can then be applied in an upward direction to restore the geometry of the posts 2 and base 3.

What is claimed is:

1. A method of forming a platform-based shipping container comprising the steps of:

(a) forming a beam having an "I" profile formed by welding a top-flange, a bottom flange and a web together, the welding causing residual stresses in said beam, said beam having an initial generally upwardly arching camber;

(b) after the step of forming the beam, placing the beam in a jig that comprises at least two fixed stops to support the beam and at least one ram;

(c) energizing the ram such that the ram presses down onto the beam until the beam is permanently deflected downwardly relative to said initial camber, thereby reducing residual stresses in said beam caused by welding;

(d) repeating steps (a)–(c) with respect to a plurality of additional beams;

(e) forming a platform base comprising said beams arranged longitudinally; and (f) fixing corner posts into an erect position relative to the platform base.

2. A method as defined in claim 1, in which the step of forming a platform base further comprises attaching transverse end rails to said beams and attaching floor bearers to said platform base.

3. A method as defined in claim 1, wherein after step (c) is performed, the method further comprises permanently deflecting said beam in an opposite direction to which it is deformed in step (c).

4. A method as defined in claim 1, wherein the method further comprises cutting apertures into the web.

5. A method as defined in claim 4, wherein the method further comprises cutting apertures into the top-flange.

6. A method as defined in claim 5, wherein the method further comprises cutting apertures into the bottom flange.

7. A method as defined in claim 4 wherein the method further comprises cutting apertures into the bottom flange.

8. A method as defined in claim 1 wherein the method further comprises cutting apertures into the top-flange.

9. A method as defined in claim 1 wherein the method further comprises cutting apertures into the bottom flange.

10. A method of forming a platform-based shipping container comprising the steps of:

(a) forming a beam having a top-flange, a bottom flange and a web by welding the top flange, bottom flange and web together, said beam having an initial upwardly-arching camber;

(b) pressing down onto the beam until the beam is permanently deflected downwardly relative to said initial camber;

(c) repeating steps (a) and (b) with respect to a plurality of additional beams;

(d) forming a platform base comprising said beam and said additional beams arranged longitudinally; and (e) fixing corner posts into an erect position relative to the platform base.

11. A method as defined in claim 10, wherein after step (b) is performed, the method further comprises permanently deflecting said beam in an opposite direction to which it is deformed in step (b).

* * * * *